US012133617B2

(12) United States Patent
Bing et al.

(10) Patent No.: US 12,133,617 B2
(45) Date of Patent: Nov. 5, 2024

(54) PAPER ROLL DISPENSER

(71) Applicant: Cintas Corporate Services, Inc., Cincinnati, OH (US)

(72) Inventors: Richard R. Bing, West Chester, OH (US); Megan Kathryn Helms, Hamilton, OH (US); David Steven Mesko, Wyoming, OH (US); Adem Önalan, Jersey City, NJ (US); Marco C. Perry, Brooklyn, NY (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 522 days.

(21) Appl. No.: 17/475,433

(22) Filed: Sep. 15, 2021

(65) Prior Publication Data

US 2022/0192441 A1 Jun. 23, 2022

Related U.S. Application Data

(60) Provisional application No. 63/129,164, filed on Dec. 22, 2020.

(51) Int. Cl.

| | |
|---|---|
| ***A47K 10/38*** | (2006.01) |
| ***A47K 10/22*** | (2006.01) |
| ***B65H 26/00*** | (2006.01) |
| *A47K 10/32* | (2006.01) |

(52) U.S. Cl.

CPC ..... *A47K 10/3836* (2013.01); *A47K 10/22* (2013.01); *A47K 10/3845* (2013.01); *B65H 26/00* (2013.01); *A47K 2010/3233* (2013.01)

(58) Field of Classification Search

CPC ..... A47K 10/22; A47K 10/3845; A47K 10/3836; A47K 2010/3233; B65H 26/00; B65H 37/005; B65H 75/185

See application file for complete search history.

(56) References Cited

U.S. PATENT DOCUMENTS

| | | | | |
|---|---|---|---|---|
| 4,314,679 A | | 2/1982 | Paul et al. | |
| 4,998,681 A | | 3/1991 | McNeill | |
| 5,022,577 A | * | 6/1991 | Fike | B65H 49/205 225/46 |
| 5,058,792 A | * | 10/1991 | Morand | A47K 10/3836 225/53 |

(Continued)

*Primary Examiner* — Gene O Crawford
*Assistant Examiner* — Kelvin L Randall, Jr.
(74) *Attorney, Agent, or Firm* — Wood Herron & Evans LLP

(57) ABSTRACT

A dispenser for rolled paper includes a shell mounted to a spindle assembly which is mounted to a wall for convenient access in a bathroom or other facility. The dispenser also includes a lid assembly mounted to the shell and spindle assembly for rotational or pivotal movement to and between closed and open configurations. When in the closed configuration, a free edge of the paper roll may be pulled from the roll and the roll rotates on the spindle assembly for dispensing the paper. The paper roll may be inspected and/or replaced by rotation of the lid assembly about a pivot pin to an open configuration. Cooperating cam and cam surfaces and the bias of a spring on the pivot pin urge the lid assembly away from the shell during rotation toward the open configuration to allow for proper clearance and positioning of the lid assembly relative to the shell.

17 Claims, 9 Drawing Sheets

(56) References Cited

U.S. PATENT DOCUMENTS

| | | | | | |
|---|---|---|---|---|---|
| 5,065,924 | A * | 11/1991 | Granger | A47K 10/3818 | 225/53 |
| 5,374,008 | A | 12/1994 | Halvorson et al. | | |
| 5,456,421 | A | 10/1995 | Reed | | |
| 6,161,796 | A * | 12/2000 | Daniels | A47K 10/3836 | 242/598.5 |
| 6,409,120 | B1 | 6/2002 | Tramontina et al. | | |
| D461,669 | S | 8/2002 | Cheng | | |
| 6,502,781 | B1 | 1/2003 | Tramontina | | |
| D471,748 | S | 3/2003 | Moore | | |
| D493,643 | S | 8/2004 | Snell | | |
| 6,786,448 | B2 * | 9/2004 | Arcilesi | A47K 10/3836 | 242/597.5 |
| 6,959,890 | B1 | 11/2005 | Breitinger | | |
| 7,178,691 | B1 | 2/2007 | Rux | | |
| 7,370,826 | B2 | 5/2008 | Neveu | | |
| 7,988,085 | B2 * | 8/2011 | Cattacin | A47K 10/3836 | 242/596.7 |
| D675,037 | S | 1/2013 | Sinotte et al. | | |
| D714,569 | S | 10/2014 | Cohen | | |
| D775,850 | S | 1/2017 | Tsai | | |
| D825,961 | S | 8/2018 | Vaults | | |
| 10,219,658 | B2 | 3/2019 | Simmons | | |
| 10,292,544 | B1 | 5/2019 | Bonner et al. | | |
| 10,426,193 | B2 * | 10/2019 | Schennum | A24F 15/20 | |
| D895,318 | S | 9/2020 | Dratch | | |
| 11,311,460 | B1 * | 4/2022 | Gershoni | A61J 1/035 | |
| 11,854,680 | B1 * | 12/2023 | Gershoni | A61J 7/049 | |
| 2013/0079923 | A1 * | 3/2013 | Cittadino | A47K 10/36 | 700/232 |

* cited by examiner

PAPER ROLL DISPENSER

This claims the benefit of U.S. Provisional Patent Application Ser. No. 63/129,164, filed Dec. 22, 2020 and hereby incorporated by reference in its entirety.

BACKGROUND OF THE INVENTION

This invention relates to rolled paper dispensers for delivering absorbent paper products such as toilet tissue, hand towels and the like. Specifically, this invention relates to a toilet tissue holding and dispensing device that is vandal resistant and substantially reduces the risk of theft of the toilet tissue roll.

Toilet paper for sanitary purposes is generally manufactured either in a roll form or in the form of interleaved sheets packaged in a box. When in roll form, the paper is of a continuous nature with tear off or perforated break lines at predetermined intervals, the paper being rolled about a central hollow core generally formed of paperboard or the like. Commercial and consumer absorbent paper products typically are distributed and dispensed from rolls. Rolled paper products may be dispensed, stored and maintained using a hollow cylindrical core which forms the support structure about which the paper is wrapped. Most paper toweling and consumer toilet tissue products contain a paperboard core, and the rolled product is often dispensed by mounting the core on a spindle passing through the core of the roll. In public environments such as public bathrooms, there is often a considerable wastage of the paper, such as when large quantities of paper are removed from the roll. Another problem encountered in such situations, is the theft of the toilet roll itself. One problem associated with public toilet facilities is the amount of seclusion inherent therein. This seclusion increases the possibility of theft of the toilet tissue.

Heretofore, a significant number of dispensers have been developed that are presumably sufficient for the purpose for which they were intended. However, in many designs, the tissue roll is readily accessible to persons within the public facility thereby increasing the possibility of theft of the roll. In large buildings, or public areas, such as highway rest areas, a significant amount of money is expended on toilet tissue, which cost is further increased by theft. As such, the need exists for a toilet tissue dispenser which secures the roll in such a manner that it may be easily utilized, while simultaneously resisting the theft of the roll.

The seclusion available in public toilet facilities, in combination with the general public access, also creates an ideal forum for vandalism. All public facilities, and especially facilities in roadside rest areas, schools, and government buildings are inherently susceptible to vandalism which increases operating costs, increases safety concerns, and also detracts from the aesthetic appearance of the building. A number of toilet tissue dispensers are also known in the art, but they can be complicated, and easily vandalized. Specifically, there is a need for a toilet tissue dispenser which cannot be removed from the wall without substantially destroying the wall, and also a dispenser which itself is not susceptible to vandalism or misuse. One common issue with such public facilities is the improper use and/or theft of the paper supplies.

Thus, the need exists for a toilet tissue dispenser which secures the toilet tissue roll within the dispenser against theft and which is resistant to vandalism and improper use and appropriation of the paper supplies. Unauthorized removal of toilet paper from dispensers is a major problem in commercial and public restrooms. Specifically, increased costs result from theft and misuse of toilet paper from such restrooms. Further, the toilet paper is often used in vandalism in the restrooms or in adjacent areas, resulting in additional cost for cleaning or repair. Various approaches exist to prevent or reduce unauthorized removal of toilet paper from dispensers. Many of these approaches involve specially designed dispensers including locking systems having keys. Such approaches were generally disadvantageous because they may not be utilized in existing dispensers and generally required the use of keys or the like by restroom maintenance personnel to place toilet paper in the dispensers.

Another problem faced in commercial and public restrooms is the premature replacement of partial toilet paper rolls with new rolls. Thus, the costs of toilet paper for the restroom are increased because of the inefficient use of less than the entire roll.

Thus, a need has arisen for dispensers which prevent the unauthorized removal and misuse of toilet paper and like rolled paper product and which is of a simple construction. Further, a need has arisen for a method for preventing unauthorized removal and use of toilet paper which may be utilized in existing dispensers. Additionally, a need has arisen for a dispenser which prevents premature replacement of partial rolls of rolled material with new rolls.

SUMMARY OF THE INVENTION

These and other shortcomings in the prior art have been addressed and overcome by various embodiments of this invention which is dispenser for rolled paper. The dispenser may include a shell mounted to a spindle assembly which is mounted to a wall for convenient access in a bathroom or other facility. The dispenser also includes a lid assembly mounted to the shell and spindle assembly for rotational or pivotal movement to and between closed and open configurations. When in the closed configuration, a free edge of the paper roll may be pulled from the roll and the roll rotates on the spindle assembly for dispensing the paper. If the paper roll is not appropriately sized for the dispenser, a toothed barb on the spindle assembly may inhibit rotation of the roll and the removal of the paper from the roll.

The paper roll may be inspected and/or replaced by rotation of the lid assembly about a pivot pin to an open configuration. Cooperating cam and cam surfaces and the bias of a spring on the pivot pin urge the lid assembly away from the shell during rotation toward the open configuration to allow for proper clearance and positioning of the lid assembly relative to the shell.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein:

FIG. 1*l* is a side elevational view of the spindle assembly of FIGS. 8-9;

DETAILED DESCRIPTION OF THE INVENTION

Figure 1:
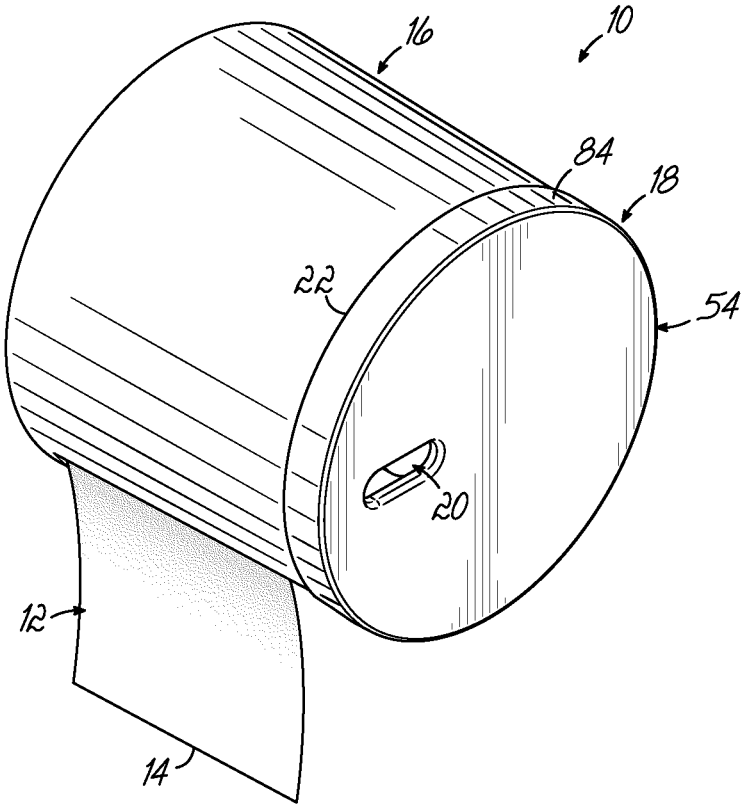
FIG. 1 is a perspective view of one embodiment of a tissue dispenser according to this invention.

Referring to FIG. 1, a perspective view of one embodiment of a tissue paper dispenser 10 according to this invention is shown. The dispenser 10 is adapted to house a roll 12 of tissue paper, toilet paper or other rolled product for dispensing from a free end 14 of the roll 12. The roll 12 commonly has an inner open core 13. The dispenser 10 includes a shell 16 and a lid assembly 18 which is pivotal relative to the shell 16. The lid assembly 18 is coupled to a distal end of the shell 16. A viewing window 20 may be included in the lid assembly 18 through which one may view the roll 12 within the shell 16 to determine if replacement of the roll 12 is needed or another purpose. In some embodiments of this invention, a sensor 21 (see FIG. 5) may be secured to the dispenser 10 to monitor the status of the roll 12 and produce a signal when the roll 12 is to be replaced.

In various embodiments, the shell 16 is generally cylindrical and the lid assembly is 18 circular with a similar diameter to that of the shell 16. The shell 16 and lid assembly 18 mate at a seam 22 when the lid assembly 18 is in a closed position relative to the shell 16 as in FIG. 1. The dispenser 10 is adapted to be mounted on a wall surface (not shown) positioned on an end of the shell 16 opposite from the lid assembly 18. The shell 18 covers approximately 250° of the circumference of a cylinder with the remaining approximately 110° being open and directed downwardly as seen in FIG. 2.

Figure 2:
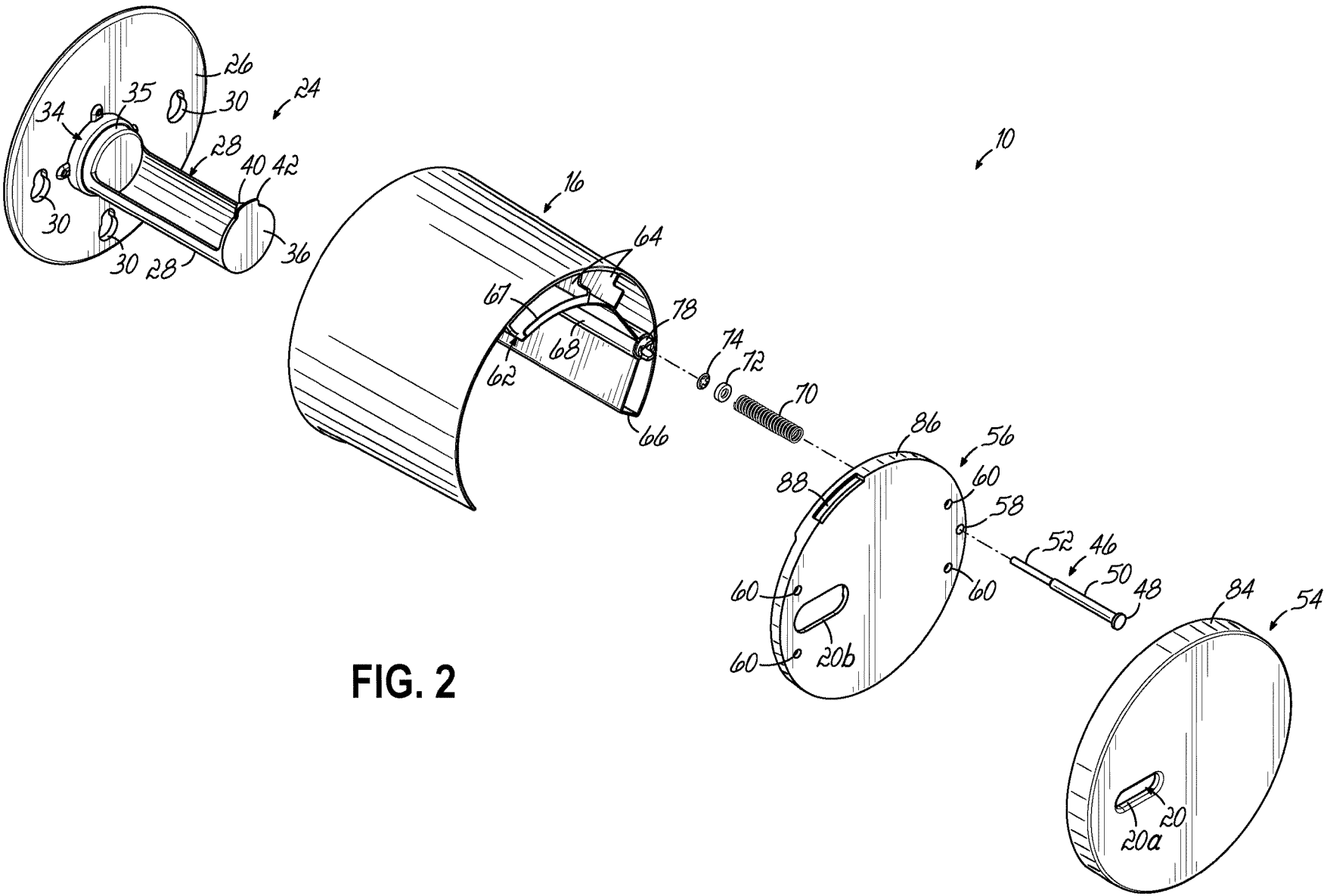
FIG. 2 is an exploded perspective view of the components of the tissue dispenser of FIG. 1.

An exploded perspective view of the components of one embodiment of the dispenser 10 is shown in FIG. 2. The dispenser 10 includes a spindle assembly 24 with a mounting member in the form of a mounting plate 26 and a spindle 28 secured to the mounting plate 26 (see additionally FIGS. 8-11). The spindle 28 may be inserted into the core 13 of the paper roll 12 to mount the roll 12 on the spindle assembly. A proximal end of the shell 16 is juxtaposed to the mounting plate 26. The mounting plate 26 may have a circular shape and include mounting holes 30 through which fasteners or screws may secure the dispenser 10 to the wall. The spindle 28 may be integrally molded to the mounting plate 26 or fastened to it with screws 32 or other fasteners. The spindle 28 is not mounted to the center of the mounting plate 26, but it is offset along a lateral axis of the mounting plate 26 (see FIG. 5) in various embodiments of the dispenser 10. The spindle 28 according to one embodiment includes a hub 34 juxtaposed to the mounting plate 26 and a cap 36 spaced from the hub 34 by a trough member 38. The hub 34 includes a shoulder 35. The trough member 38 is circular semi-cylindrical and upwardly open as shown in FIGS. 2 and 8-11. The cap 36 includes a generally triangular tooth or barb 40 extending toward the hub 34 from an upwardly oriented tab 42 on the cap 36. An aperture 44 may be formed in the trough member 38 adjacent to the cap 36 for molding or other purposes as needed.

Figure 12C:
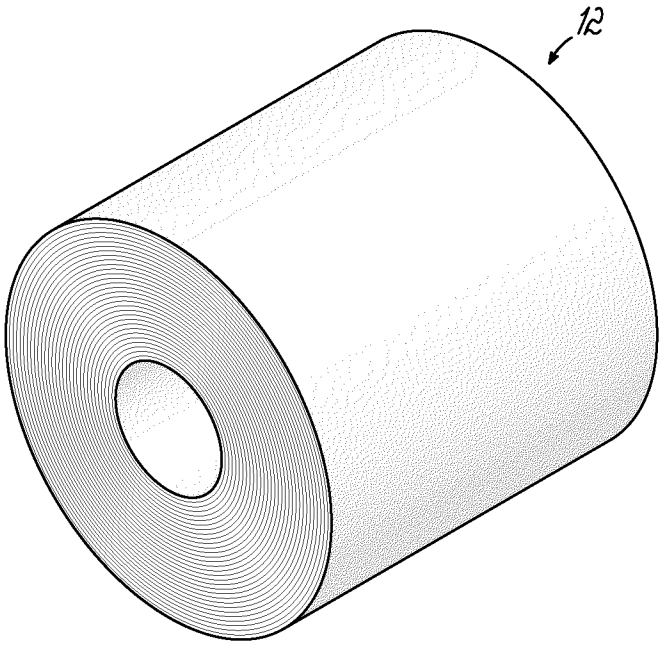
FIGS. 12A-12C are views a roll of tissue paper compatible with various embodiments of this invention.
Figure 12B:
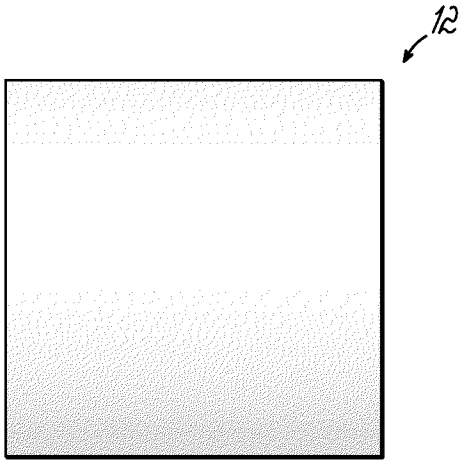
Figure 12A:
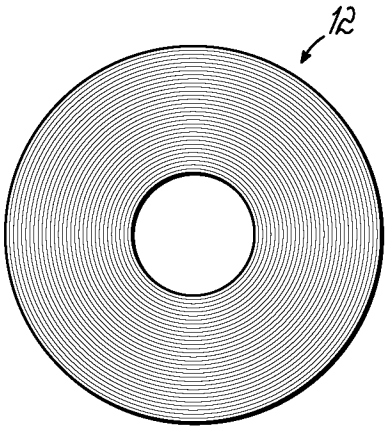

The roll of paper 12 is placed on the spindle 28 for dispensing by inserting the spindle 28 into the core 13 of the roll 12. An exemplary roll of paper 12 is shown in FIGS. 12A-12C with exemplary dimensions for mounting on the spindle 28 of various embodiments of this invention. The roll 12 may be seated on the tooth 40 proximate the cap 36 and the shoulder 35 proximate the hub 34 and restrained by the upstanding tab 42. In use, the roll of paper 12 is dispensed by a user pulling on the free edge 14 and the roll 12 rotating on the tooth 40 and shoulder 35 around the trough member 38 until the user ceases pulling on the paper roll 12. The free edge 14 and adjoining paper may be torn from the roll 12 by pulling it against the adjacent edge of the shell 16. If the paper roll 12 is not appropriately sized for use in the dispenser 10, the toothed barb 40 may poke into the roll 12 and/or otherwise inhibit rotation of the roll 12 on the trough member 38.

Figure 7:
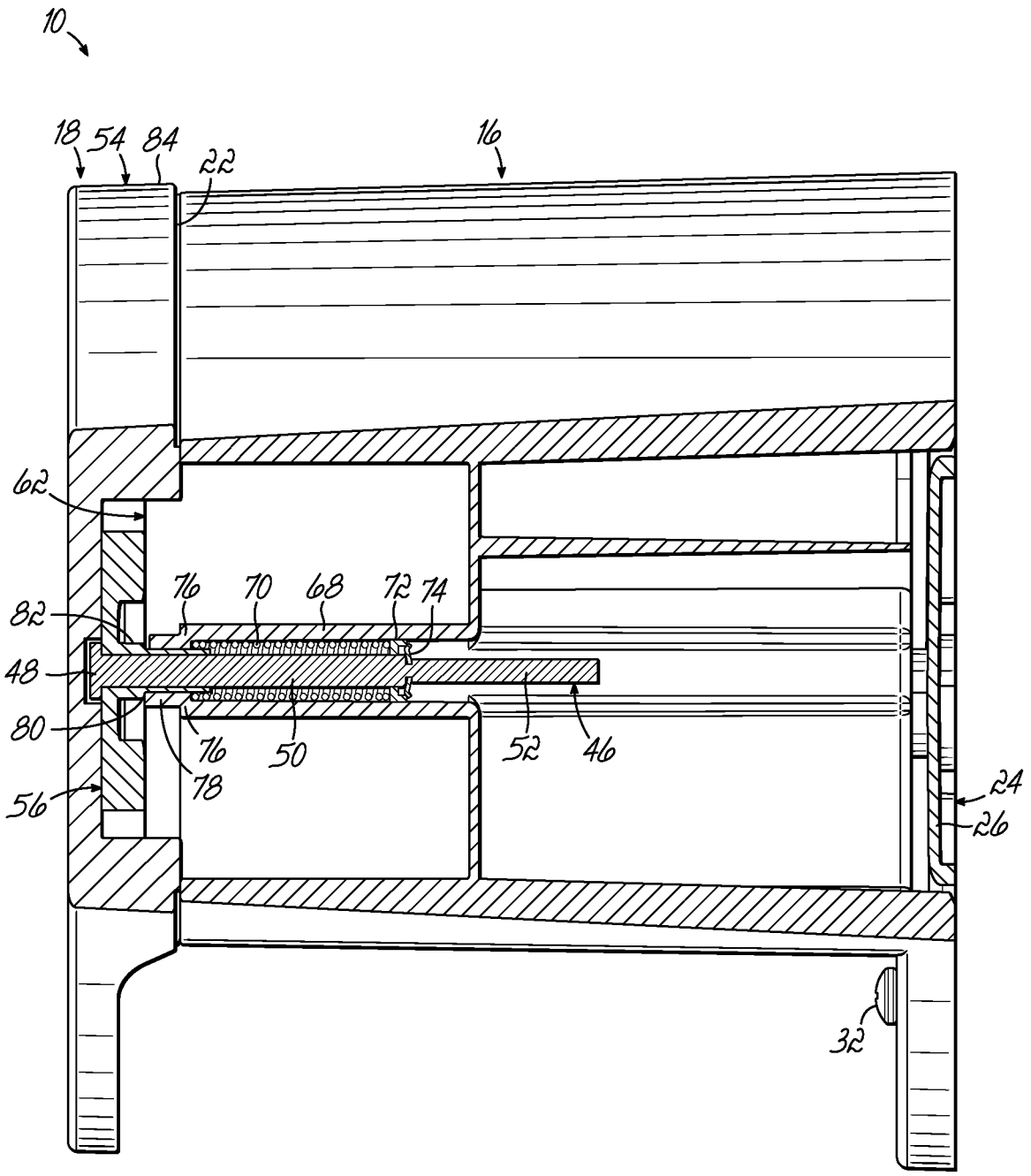
FIG. 7 is a cross-sectional view of the tissue dispenser of FIG. 4 taken along line 7-7.
Figure 9:
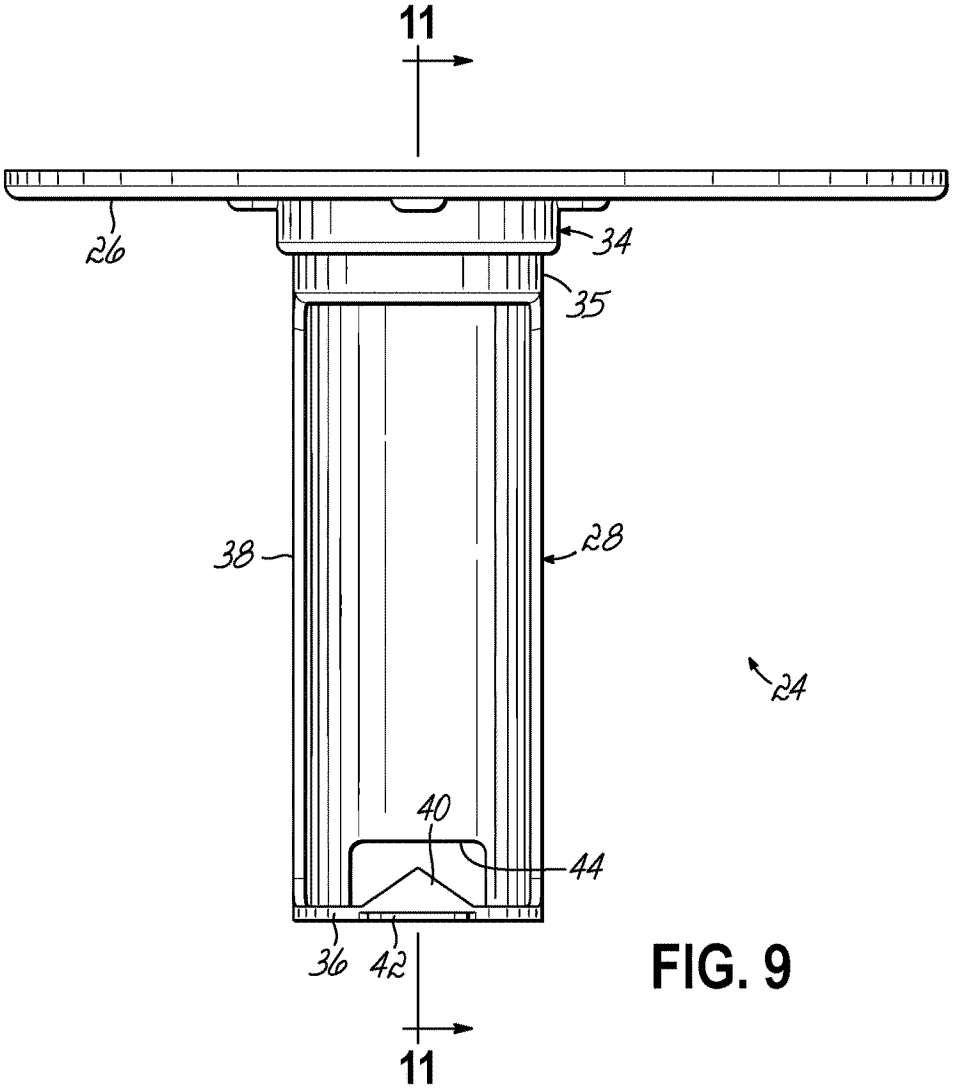
FIG. 9 is a top plan view of the spindle assembly of FIG. 8.
Figure 8:
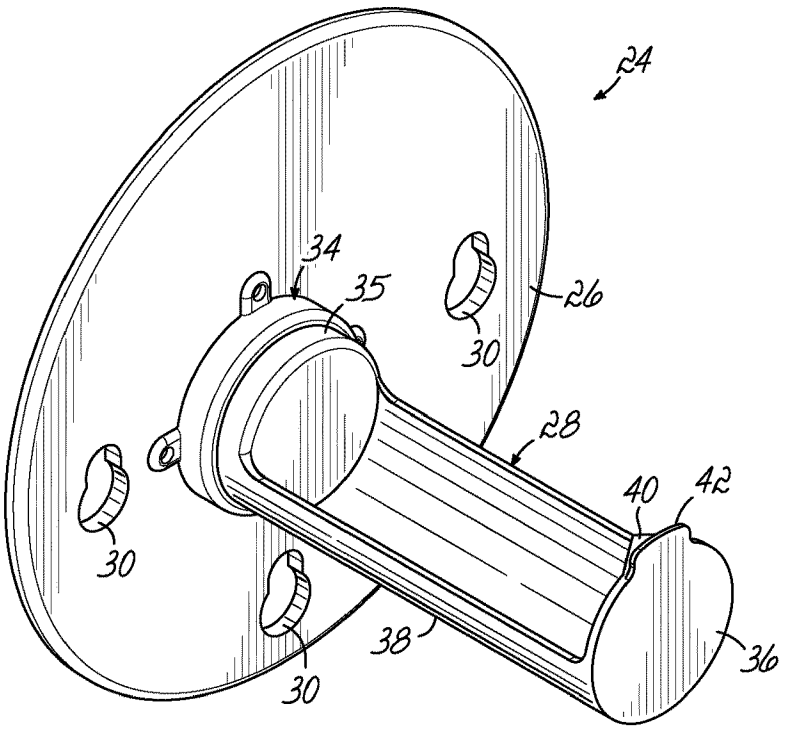
FIG. 8 is a perspective view of a spindle assembly of the tissue dispenser of FIG. 1.
Figure 11:
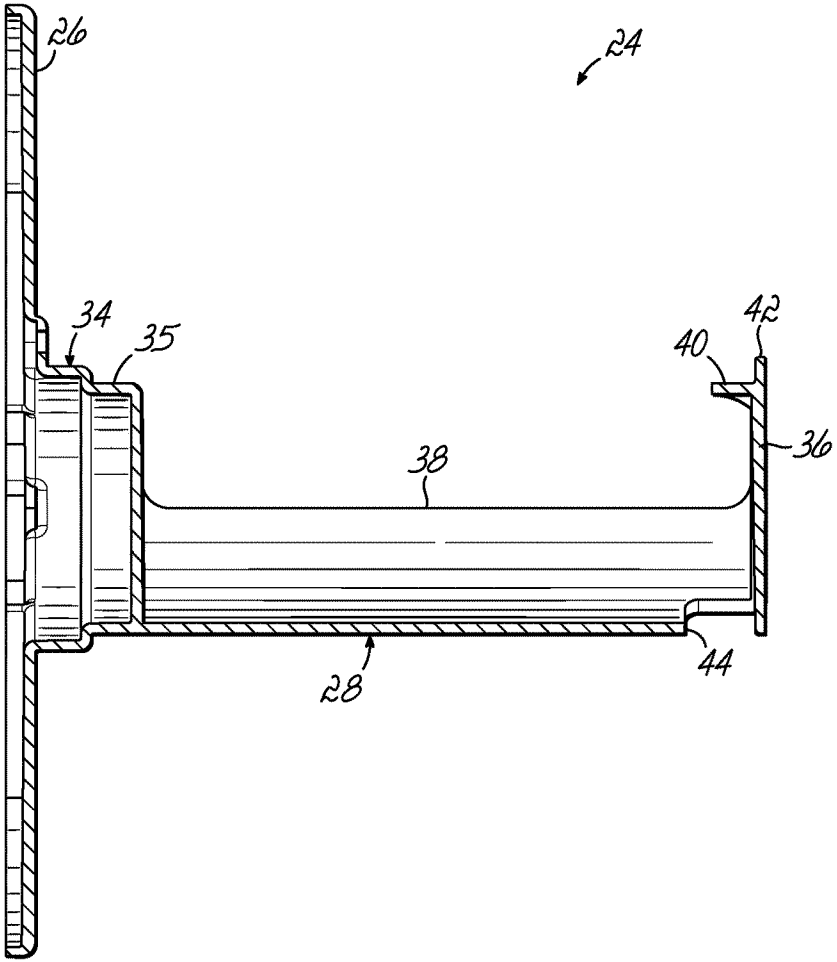
FIG. 11 is cross-sectional view taken along line 11-11 of FIG. 9.
Figure 10:
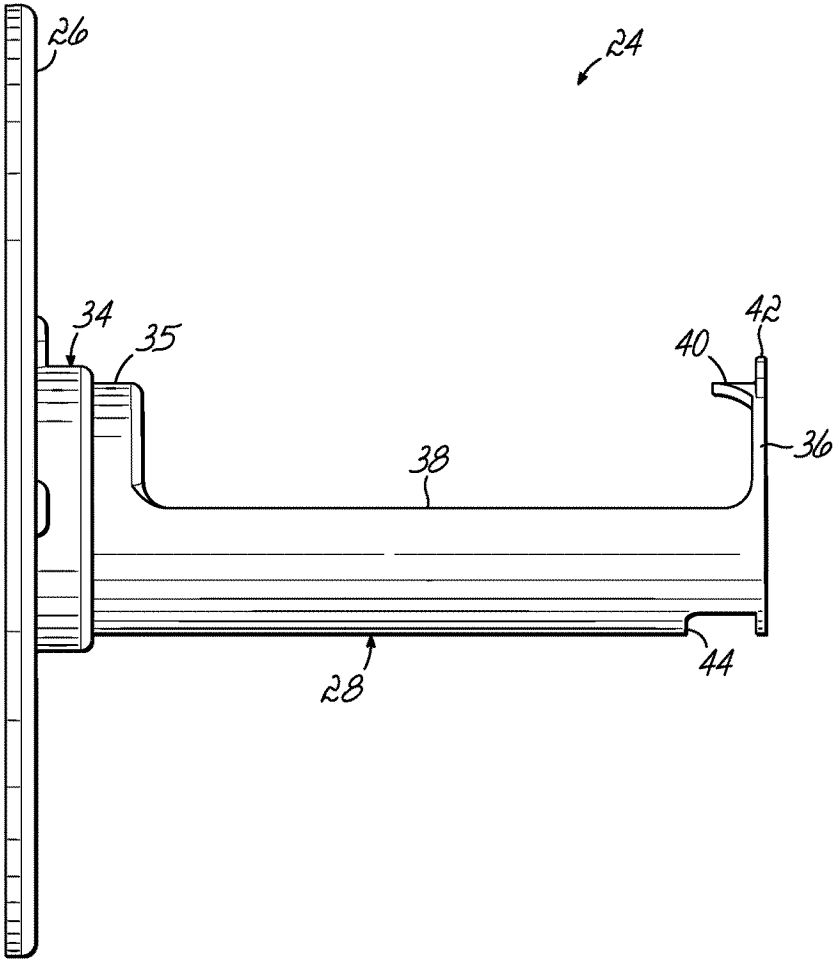

A pivot pin 46 pivotally connects the lid assembly 18 to the shell 16. The pivot pin 46 may have a head 48 and first and second 50, 52 shaft regions with the first shaft region 50 adjacent to the head 48 having a greater diameter than the second shaft region 52 distal to the first shaft region 50. The lid assembly 18 may further include a lid 54 and a lid plate 56 each of which are generally circular and of the same diameter. The pivot pin 46 may be inserted through a pivot pin hole 58 in the lid plate 56. Attachment holes 60 may be used for fasteners 61 (see FIG. 3) to secure the lid plate 56 to the lid 54 with the head 48 of the pivot pin 46 captured between the lid 54 and lid plate 56 as shown in FIG. 7. The lid 54 and lid plate 56 may each have a port 20*a*, 20*b*, respectively, which contribute to form the viewing window 20 when the lid 54 and lid plate 56 are assembled into the lid assembly 18.

Figure 3:
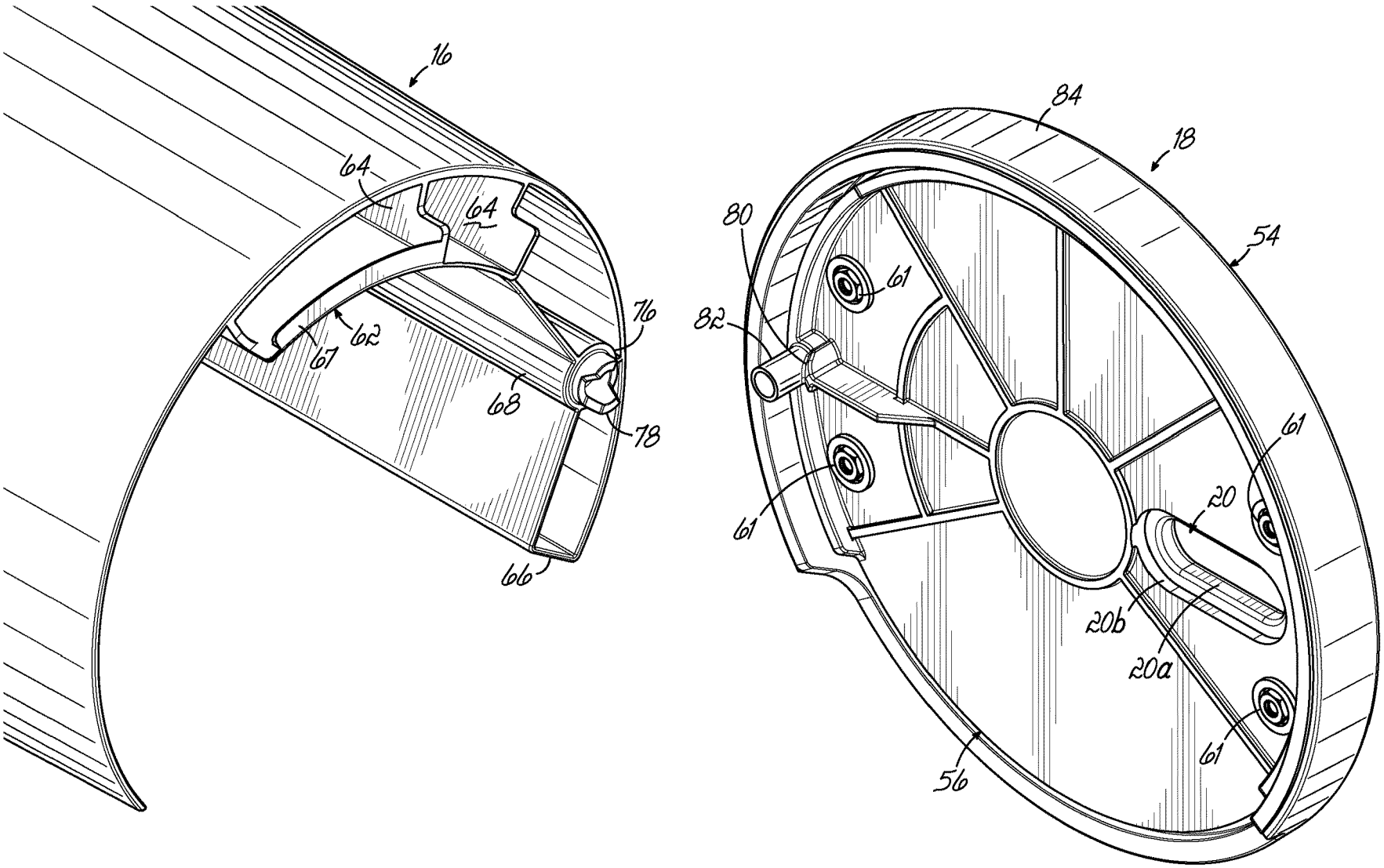
FIG. 3 is an enlarged perspective view of a shell and lid assembly of the embodiment of FIGS. 1-2.

The shell 16 has an inner arcuate shell wall 62 joined to the shell 16 by a number of spaced ribs 64 and an end cap 66 as shown in FIG. 2. An upturned flange 67 is formed on the edge of the inner arcuate shell wall 62 adjacent to the lid assembly 18. A pivot pin sleeve 68 is formed between the inner shell wall 62 and the shell 16 to receive the first and second shaft regions 50, 52 of the pivot pin 46 therein as shown in FIG. 7. A spring 70 is concentrically mounted on the first shaft region 50 of the pivot pin 46 and a washer 72 and push nut 74 are seated on the pivot pin 46 proximate the juncture between the first and second shaft regions 50, 52 to compress the spring 70 against a bulkhead 76 formed in the sleeve 68. A cam member 78 is formed at the mouth of the sleeve 68 as shown in FIG. 3. A cam surface 80 is formed adjacent to a barrel 82 projecting from the lid plate 56 confronting the shell 16. The pivot pin 46 projects through the barrel 82 and the barrel 82 projects into the mouth of the sleeve 68 as shown in FIG. 7 to seat the cam 78 against the cam surface 80.

Figure 5:
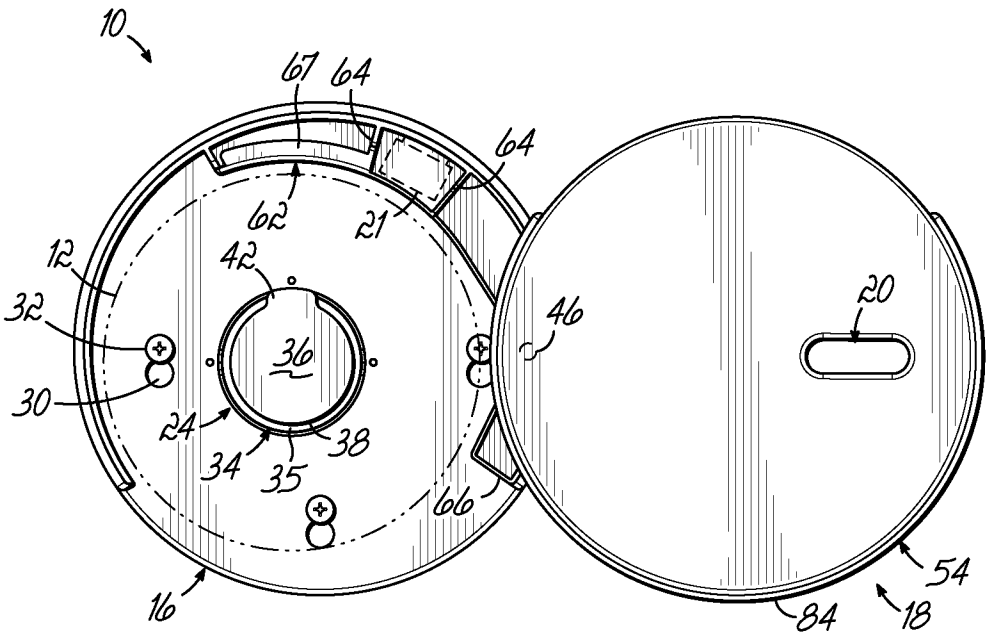
FIG. 5 is a view similar to FIG. 4 with the tissue dispenser in an open configuration.

The lid 54 includes a peripheral rim 84 extending partially around about 250° of the outer circumference of the lid 54 as shown in FIG. 5. The lid plate 56 also has a peripheral rim 86 extending partially around the outer circumference of the lid plate 56. The extent of the lid plate rim 86 corresponds and aligns generally with the lid rim 84. An arcuate notch 88 is formed in the lid plate 56 adjacent to the juncture of the lid plate 56 with the lid plate rim 86 (see FIG. 2).

Figure 4:
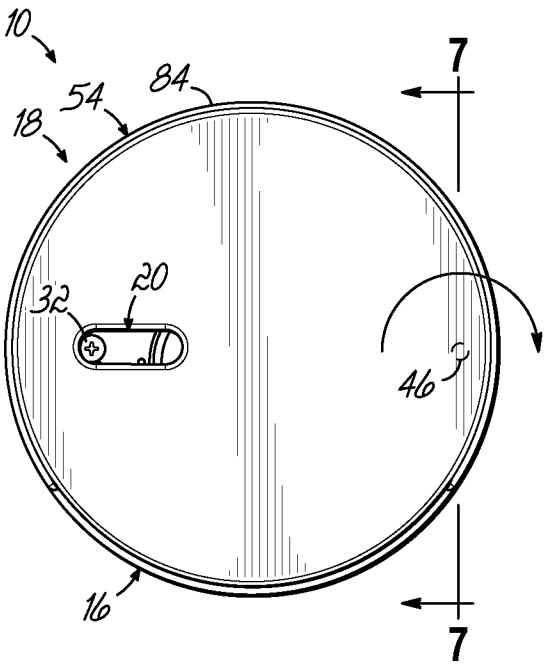
FIG. 4 is a front elevational view of the tissue dispenser of FIGS. 1-2 in a closed configuration.
Figure 6:
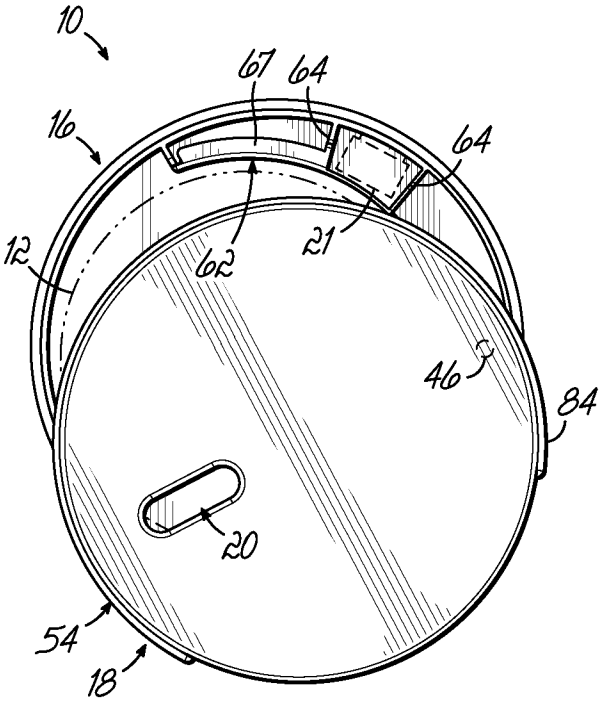
FIG. 6 is a view similar to FIGS. 4-5 with the tissue dispenser in transition between the closed and open configurations.

The dispenser 10 in the closed and dispensing configuration is shown in FIG. 1 with the lid assembly 18 seated on the shell 16 with the free edge 14 of the paper roll 12 projecting from the open portion of the shell 16. Access to the spindle assembly 24 and the paper roll 12 for replacement or other purposes may be accomplished with the dispenser 10 of various embodiments of this invention by converting it from the closed configuration to an open configuration as shown in FIG. 5. A user may pivot the lid assembly 18 about the pivot pin 46 in the direction of arrow A in FIG. 4. By doing so, the cam 78 and cam surface 80 interact with each other to urge the lid assembly 18 away from the shell 16 in a direction generally perpendicular to the mounting plate 26 as it is being pivoted about the pivot pin 46. This allows for appropriate clearance between the lid assembly 18 and the shell 16 for movement of the lid assembly 18 to the open configuration shown in FIG. 5 which provides for access to the spindle assembly 24 and paper roll 12 thereon. Pivotal movement of the lid assembly 18 from the open configuration toward the closed configuration draws the lid assembly 18 toward the shell 16 as a result of the bias provided by the spring 70 on the pivot pin 46. As the lid assembly 18 approaches the shell 16 and the closed configuration, the flange 67 on the inner shell wall 62 may be seated in the notch 88 on the lid plate 56 to releasably secure the lid assembly 18 in the closed configuration on the shell 16.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A dispenser for a roll of paper, the dispenser comprising:

a mounting member adapted to mount the dispenser to a generally vertical wall;

a spindle assembly projecting generally perpendicularly from the mounting member and adapted to support the roll of paper thereon;

a shell surrounding at least an upper portion of the roll of paper when supported on the spindle assembly, the shell having a proximal end juxtaposed to the mounting member and a distal end spaced from the proximal end; and a lid assembly movably mounted to the distal end of the shell for movement to and between an open configuration and a closed configuration in which the roll of paper may be installed on and removed from the spindle assembly when the lid assembly is in the open configuration;

wherein the roll of paper has a central core, the spindle assembly further comprising:

a barb on the spindle assembly projecting into the core when the roll of paper is properly sized on the spindle assembly and projecting into the roll of paper and thereby inhibiting rotation of the roll of paper relative to the spindle assembly when the roll of paper is not properly sized for the dispenser.

2. The dispenser of claim 1 further comprising:

a cam member and a cam surface at a juncture between the lid assembly and the distal end of the shell, wherein the cam member interacts with the cam surface when the lid assembly is moved to and between the open and closed configurations such that the lid assembly is closer to the proximal end of the shell when in the closed configuration than when the lid assembly is in the open configuration.

3. The dispenser of claim 2 wherein the lid assembly is biased away from the proximal end.

4. The dispenser of claim 1 further comprising:

a pivot pin pivotally coupling the lid assembly to the shell.

5. The dispenser of claim 1 wherein the spindle assembly further comprises:

a hub adjacent to the mounting member;

a tab spaced from the hub;

wherein the roll of paper is mounted for rotation between the tab and the hub for dispensing from the dispenser.

6. The dispenser of claim 1 wherein the spindle assembly further comprises:

a spindle projecting through the core when the roll of paper is mounted on the spindle assembly for dispensing.

7. The dispenser of claim 1 wherein the spindle is not centered within the shell.

8. The dispenser of claim 1 wherein the spindle is not centered on the mounting member.

9. The dispenser of claim 1 wherein the shell has a generally arcuate configuration.

10. The dispenser of claim 1 wherein the shell has a downwardly oriented opening through which a free end of the roll of paper may be accessed by a user to dispense the roll of paper from the dispenser.

11. The dispenser of claim 1 wherein the lid assembly further comprises:

a viewing window through which a user may determine a quantity of the roll of paper remaining in the dispenser when the lid assembly is in the closed configuration.

12. The dispenser 1 further comprising:

a sensor to provide an indication to a user when the roll of paper needs to be replenished.

13. A dispenser for a roll of paper having a central core, the dispenser comprising:

a mounting member adapted to mount the dispenser to a generally vertical wall;

a spindle assembly projecting generally perpendicularly from the mounting member and adapted to support the roll of paper thereon, the spindle assembly including a spindle projecting through the core of the roll of paper;

a shell surrounding at least an upper portion of the roll of paper when supported on the spindle assembly, the shell having a proximal end juxtaposed to the mounting member and a distal end spaced from the proximal end;

wherein the shell has a downwardly oriented opening through which a free end of the roll of paper may be accessed by a user to dispenser the roll of paper from the dispenser;

wherein the spindle is not centered within the shell;

a lid assembly pivotally mounted to the distal end of the shell for movement to and between an open configuration and a closed configuration in which the roll of paper may be installed on and removed from the spindle assembly when the lid assembly is in the open configuration;

a viewing window through which a user may determine a quantity of the roll of paper remaining in the dispenser when the lid assembly is in the closed configuration;

a cam member and a cam surface at a juncture between the lid assembly and the distal end of the shell, wherein the cam member interacts with the cam surface when the lid assembly is moved to and between the open and closed configurations such that the lid assembly is closer to the proximal end of the shell when in the closed configuration than when the lid assembly is in the open configuration;

wherein the lid assembly is biased away from the proximal end;

a pivot pin pivotally coupling the lid assembly to the shell; and a barb on the spindle assembly projecting into the core when the roll of paper is properly sized on the spindle and projecting into the roll of paper and thereby inhibiting rotation of the roll of paper relative to the spindle when the roll of paper is not properly sized for the dispenser.

14. The dispenser of claim 13 wherein the spindle assembly further comprises:

a hub adjacent to the mounting member;

a tab spaced from the hub;

wherein the roll of paper is mounted for rotation between the tab and the hub for dispensing from the dispenser.

15. A dispenser for a roll of paper having a central core, the dispenser comprising:

a mounting member adapted to mount the dispenser to a generally vertical wall;

a spindle assembly projecting generally perpendicularly from the mounting member and adapted to support the roll of paper thereon, the spindle assembly including a spindle projecting through the core of the roll of paper;

a shell surrounding at least an upper portion of the roll of paper when supported on the spindle assembly, the shell having a proximal end juxtaposed to the mounting member and a distal end spaced from the proximal end; and a barb on the spindle assembly projecting into the core when the roll of paper is properly sized on the spindle and projecting into the roll of paper and thereby inhibiting rotation of the roll of paper relative to the spindle when the roll of paper is not properly sized for the dispenser.

16. The dispenser of claim 15 further comprising:

a lid assembly movably mounted to the shell for movement to and between an open configuration and a closed configuration in which the roll of paper may be installed on and removed from the spindle assembly when the lid assembly is in the open configuration.

17. The dispenser of claim 15 wherein the spindle is not centered within the shell.

* * * * *